United States Patent [19]

Santiago et al.

[11] 4,386,586

[45] Jun. 7, 1983

[54] MANIFOLD ON A SIX-CYLINDER IN LINE ENGINE

[75] Inventors: Andres Santiago; Enrique Santiago, both of Diedorf, Fed. Rep. of Germany

[73] Assignee: Zeuna-Staerker GmbH & Co. KG, Fed. Rep. of Germany

[21] Appl. No.: 184,090

[22] Filed: Sep. 4, 1980

[30] Foreign Application Priority Data

Sep. 6, 1979 [DE] Fed. Rep. of Germany ..... 2935925
Sep. 6, 1979 [DE] Fed. Rep. of Germany ... 7925201[U]

[51] Int. Cl.[3] ..... F02B 75/18
[52] U.S. Cl. ..... 123/52 M; 123/59 R
[58] Field of Search ..... 123/52 M, 52 MB, 193 H, 123/59 R; 60/323

[56] References Cited

U.S. PATENT DOCUMENTS 3,845,746 11/1974 Elsbett ..... 123/52 M
4,151,716 5/1979 Sakurai et al. ..... 60/323
4,175,504 11/1979 Ederer et al. ..... 123/52 M
4,341,186 7/1982 Mayr et al. ..... 123/52 M

FOREIGN PATENT DOCUMENTS 1213670 4/1964 Fed. Rep. of Germany .
1576357 3/1970 Fed. Rep. of Germany .
2236154 4/1974 Fed. Rep. of Germany .
2129738 11/1975 Fed. Rep. of Germany .
1286368 1/1962 France ..... 123/52 M

OTHER PUBLICATIONS

SAE Journal "Automobile Design Trends in Europe", Apr. 1964, Seite 34.

*Primary Examiner*—Craig R. Feinberg
*Attorney, Agent, or Firm*—Brumbaugh, Graves, Donohue & Raymond

[57] ABSTRACT

The invention relates to a manifold on a six-cylinder in-line engine for the conduction of the exhaust gases between the engine block and the exhaust piping, the manifold comprising pipe lines which are formed by half shells consisting of sheet metal and which are welded together in their common separation plane said half shells also forming wall portions between said pipelines to provide support against thermal stresses.

2 Claims, 3 Drawing Figures

MANIFOLD ON A SIX-CYLINDER IN LINE ENGINE

BACKGROUND OF THE INVENTION

Conventional internal combustion engines (DE AS No. 12 13 670) have manifolds which are designed as castings and which are very heavy as a result of their great wall thickness. Although it is the aim in modern automotive engineering to avoid heavy parts to the greatest possible extent, nothing has changed in the past in the mode of construction of manifolds because no other possibility of controlling the high temperature differences between the cooled cylinder block and the manifold, which is subjected to the considerably higher exhaust gas temperatures, was in sight. For example, the use of individual steel pipes had to be ruled out from the outset because of the high production expenditure.

On a known manifold which is constructed according to the unit-assembly principle (DE OS No. 15 76 357), there is associated with each cylinder outlet an outlet elbow and a short pipe length which are combined so as to form a T-shaped component consisting of two half shells. The adjacent pipe line lengths are interconnected through flanges. A manifold of this kind, which consists of many components, tends to become permeable in its numerous pipe connections when subjected to the action of heat.

The invention has set itself the task of providing a light-weight-construction manifold which is specially adapted to a six-cylinder in-line engine and which permanently withstands the high thermal stresses.

To solve this problem, the invention proposes that the manifold should consist of two partial manifolds, of which one connects the first three cylinders and the other connects the remaining three cylinders, and that each partial manifold should be composed of two half shells which form, for each of the three cylinders, connecting sockets flanged thereto as well as a collecting pipe which is common to all the connecting sockets, and that the half shells should have in the zones bounded by the connecting sockets and the collecting pipe web sheets which areally adjoin the separation plane and are welded together, and that in each collecting pipe there should end, in the zone of a half shell, a pipe socket with a flanged part for the connection of the exhaust piping.

The chosen half-shell form allows a simple production by stamping or pressing. As a result of the manifold being divided into two partial manifolds, the thermal expansions are kept within limits so that the arising thermal stresses can be absorbed by the manifold. Due to the welded connection in the separation plane, the two half shells of the manifold form a constructional unit that is stable within itself. Any residual thermal expansions are compensated for through the pipe sockets which are each connected to one half shell and are flanged to the exhaust piping.

Decisive for the stability of each manifold unit composed of two half shells is the areal connection of the web sheets by edge welding and spot welding. It is only by this means that the required resistance to warping and distortion is brought about, particularly in the plane of the web sheets.

The stability of the manifold units is additionally improved in that the mouths of the connecting sockets and the pipe sockets are received in corresponding bores in connecting flanges and are welded together with these.

For reasons of output co-ordination, it is expedient that a first partial manifold connects the first three cylinders and the second partial manifold connects the remaining three cylinders. The exhaust gases are then separately conducted through the pipe sockets from the partial manifolds in an exhaust system comprising two pipes.

The sheet construction has the additional advantage that, because of its small mass, it is very rapidly heated up in the cold starting phase, causing the high exhaust-gas temperatures desired for the exhaust has purification to be reached at a particularly early stage.

Expediently, the half shells will be manufactured from heat-resistant steel sheet, preferably of a ferritic structure, which is characterised by a minimal thermal expansion.

Although the most favourable realisation of the invention is given on a six-cylinder in-line engine, it can of course also be applied to an in-line engine having eight cylinders, each partial manifold being connected to four exhaust-gas ports. However, the proposed division into two partial manifolds can be useful even if only four cylinders are provided.

An exemplified embodiment of the invention will be explained hereinafter with reference to the drawings, in which.

Figure 1:
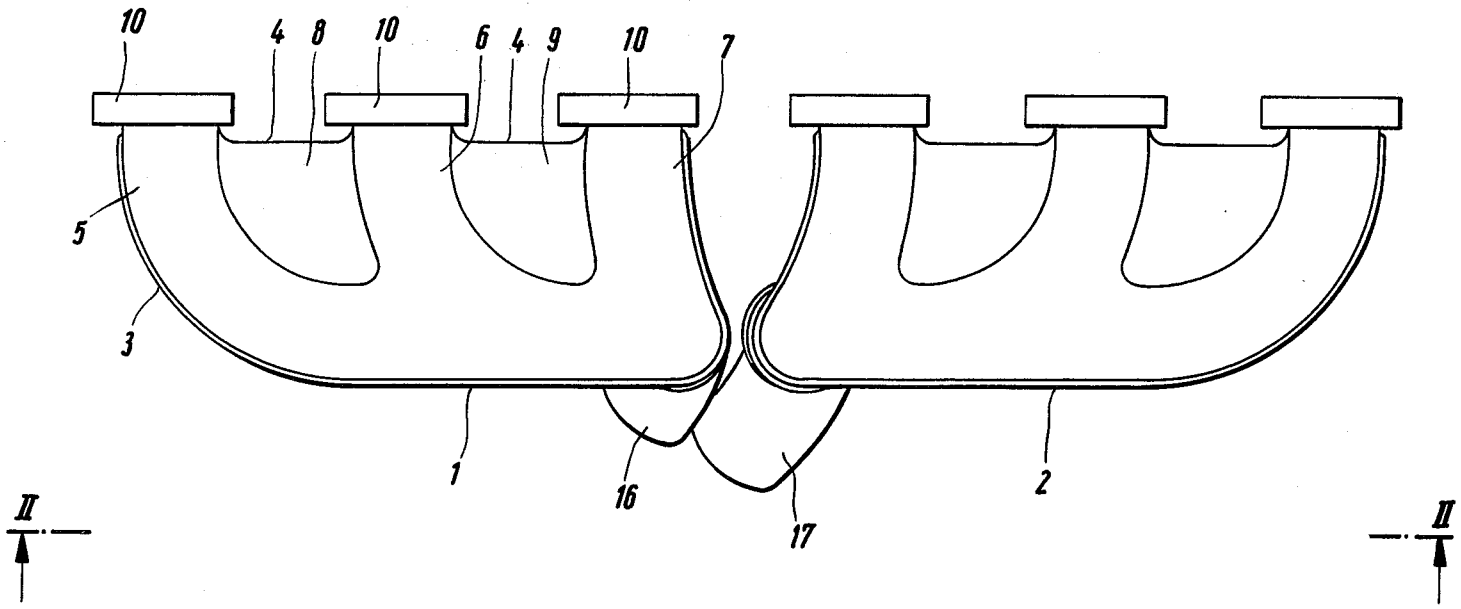
FIG. 1 shows a top view of the manifold.
Figure 2:
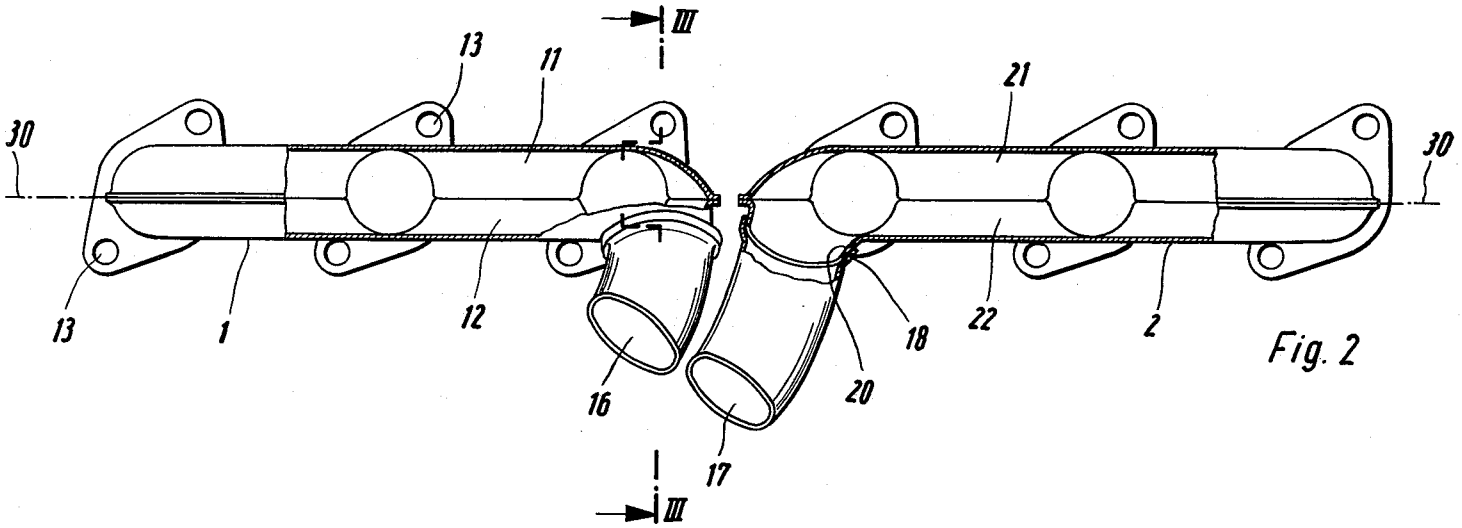
FIG. 2 shows a side view of the manifold according to II—II of FIG. 1 in a partly sectional representation.
Figure 3:
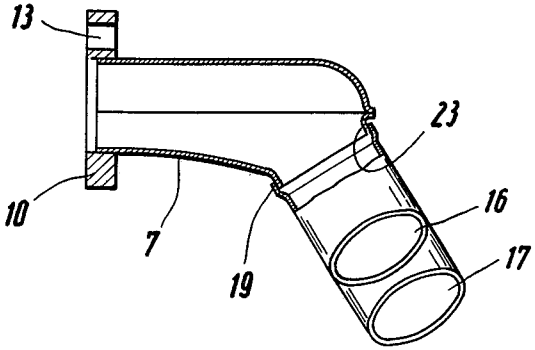
FIG. 3 shows a section according to III—III of FIG. 2.

The manifold shown in FIGS. 1 to 3 consists of two partial manifolds 1, 2 which each connect the exhaust-gas ports of three cylinders of a six-cylinder in-line engine (not shown). The partial manifolds 1, 2 consist of upper half shells 11, 21 and lower half shells 12, 22, each shell made as a sheet pressing. While forming the respective partial manifold, the two half shells are connected by welding along a common separation plane 30. An external welding seam extends along a narrow external connection flange 3; another external welding seam extends along the contour 4 of web sheets 8, 9 which are formed between the connecting bends 5, 6, 7. The web sheets 8, 9 of the two half shells are furthermore connected together by additional welding spots. The areal connection of the two half shells of each partial manifold in the zone of the web sheets 8, 9 is decisive for the resistance of the partial manifolds to thermal deformations. Only by the areally welded webs is the required resistance to deformation in the plane of the web sheets provided.

On the orifices of the connection bends, there are secured flanges 10 for the sealing fastening of the partial manifold to the engine block by means of screws through corresponding screw holes 13. Pipe sockets 16 and 17 are connected to the lower half shell 12 of the partial manifold 1 and to the lower half shell 22 of the partial manifold 2 respectively. The free ends of these pipe sockets are welded together in the interior of ports in a common flange part (not shown) which serves for establishing the connection to the likewise double-pipe exhaust piping. For reasons of simplification, the above explanations given relative to the drawing figures refer only to the respective components of the partial manifold 1 shown on the left-hand side; of course, the same applies correspondingly to the partial manifold 2 shown on the right-hand side, no further reference symbols havng been put because of the symmetry of the constructional forms.

The sectional representation of the right-hand manifold shown in FIG. 2 clearly illustrates the connection of the pipe socket 17 to the lower half shell 22.

FIG. 3 shows a comparable representation of the pipe socket 16 which is connected to the lower half shell 12 of the left-hand partial manifold 1. The pipe sockets 16, 17 serve for compensating for the thermal expansions of the two partial manifolds; they are therefore of decisive importance for reducing the thermal stresses within the two partial manifolds. The pipe sockets 16, 17 have in the zones of connection to the associated half shells 12, 22 widened shoulders 18, 19 which engage over corresponding collars 20, 23 of the respective half shells, the shoulders and the collars being connected by annular welding seams.

We claim:

1. A manifold for a six-cylinder in-line engine for conducting exhaust gases from the engine to exhaust piping, said manifold being comprised of a first partial manifold and a second partial manifold, said first partial manifold communicating with a first, second and third cylinder of said engine, said second partial manifold communicating with a fourth, fifth and sixth cylinder of said engine; each of said partial manifolds being comprised of two single layer half shells of sheet metal welded together along their respective joining seams so as to form each said partial manifold, each said partial manifold thereby having single layer sheet metal walled passages for conducting exhaust gases; said passages bounding and defining two areas between said passages and the engine, the first said area being located in the region next to and between a first pair of adjacent cylinders of the engine with which each said partial manifold communicates, the other said area being located in the region next to and between a second pair of adjacent cylinders with which each said partial manifold communicates, one of said second pair of cylinders not being one of said first pair of cylinders, said half shells including planar web portions adjacent said passages, said web portions of each half shell contacting in a common plane corresponding web portions of the half shell to which it is welded, said contacting web portions being welded together at a plurality of spots; said web portions comprising sheets which substantially extend over and enclose each of the said two areas, said web portions providing support against thermal deformation of said partial manifold; each said partial manifold including flanged connection sockets for each of the three cylinders with which the partial manifold communicates; each said partial manifold also including a collecting pipe for conducting exhaust gases away from the manifold to exhaust piping, and means for connecting the collecting pipe to the exhaust piping.

2. A manifold according to claim 1 wherein orifices in the connection sockets and in the collecting pipe are received in corresponding bores in connection flanges and are welded to said flanges.

* * * * *